US009791243B2

(12) United States Patent
Björkman et al.

(10) Patent No.: US 9,791,243 B2
(45) Date of Patent: Oct. 17, 2017

(54) SYSTEM AND METHOD FOR WEAPON EFFECT SIMULATION

(75) Inventors: Ulf Björkman, Jönköping (SE); Anders Holmquist, Jönköping (SE)

(73) Assignee: SAAB AB, Linköping (SE)

( * ) Notice: Subject to any disclaimer, the term of this patent is extended or adjusted under 35 U.S.C. 154(b) by 1013 days.

(21) Appl. No.: 10/594,452

(22) PCT Filed: Mar. 15, 2005

(86) PCT No.: PCT/EP2005/002728
§ 371 (c)(1),
(2), (4) Date: Sep. 26, 2006

(87) PCT Pub. No.: WO2005/093363
PCT Pub. Date: Oct. 6, 2005

(65) Prior Publication Data

US 2007/0243504 A1 Oct. 18, 2007

(30) Foreign Application Priority Data

Mar. 26, 2004 (EP) ..... 04075953

(51) Int. Cl.
*F41G 3/26* (2006.01)

(52) U.S. Cl.
CPC ..... *F41G 3/2655* (2013.01); *F41G 3/265* (2013.01); *F41G 3/2666* (2013.01)

(58) Field of Classification Search
CPC ..... F41G 3/26
(Continued)

(56) References Cited

U.S. PATENT DOCUMENTS 3,877,157 A * 4/1975 Ashford et al. ..... 434/22
3,907,433 A * 9/1975 Nault ..... 356/152.1
(Continued)

FOREIGN PATENT DOCUMENTS

CA 2366526 A1 9/2000
DE 19912093 A 9/2000

OTHER PUBLICATIONS

PCT/ISA/210—International Search Report—Jun. 15, 2005.
PCT/ISA/237—Written Opinion of the International Searching Authority—Jun. 15, 2005.

*Primary Examiner* — Sam Yao
*Assistant Examiner* — Alvin Carlos
(74) *Attorney, Agent, or Firm* — Venable LLP; Jeffri A. Kaminski

(57) ABSTRACT

A weapon effect simulation system including a fire simulation system and at least one hit simulation system. The fire simulation system includes a transmitter for transmitting electromagnetic waves to simulate real ammunition from a weapon and elements for including information in the electromagnetic waves. The hit simulation system includes both a receiver for receiving the transmitted electromagnetic waves and a processor for determining, based on received electromagnetic waves, whether a target has been hit. The fire simulation system further includes a calculator for calculating the imagined trajectory of the simulated ammunition and a processor for determining the geographical position of the weapon, and wherein the elements for including information in the electromagnetic waves are arranged so as to include information related to coordinates in the three-dimensional space for the calculated ammunition trajectory.

25 Claims, 5 Drawing Sheets

(58) Field of Classification Search
USPC ..... 434/5, 11, 21, 22, 23
See application file for complete search history.

(56) References Cited

U.S. PATENT DOCUMENTS

| | | | | | |
|---|---|---|---|---|---|
| 3,927,480 | A | * | 12/1975 | Robertsson | 434/22 |
| 4,218,834 | A | | 8/1980 | Robertsson | |
| 4,342,556 | A | * | 8/1982 | Hasse | 434/22 |
| 4,373,916 | A | * | 2/1983 | Ashford et al. | 434/22 |
| 4,441,809 | A | * | 4/1984 | Dudley et al. | 356/4.08 |
| 4,470,817 | A | * | 9/1984 | Diehl et al. | 434/22 |
| 4,478,581 | A | * | 10/1984 | Goda | 434/22 |
| 4,561,849 | A | * | 12/1985 | Eichweber | 434/22 |
| 4,577,962 | A | * | 3/1986 | de Guillenschmidt et al. | 356/5.05 |
| 4,682,953 | A | * | 7/1987 | Doerfel et al. | 434/16 |
| 4,737,106 | A | * | 4/1988 | Laciny | 434/22 |
| 4,744,761 | A | * | 5/1988 | Doerfel et al. | 434/13 |
| 4,830,487 | A | * | 5/1989 | Michel et al. | 356/5.05 |
| 5,100,229 | A | * | 3/1992 | Lundberg et al. | 356/3.12 |
| 5,228,854 | A | * | 7/1993 | Eldridge | 434/11 |
| 5,420,594 | A | * | 5/1995 | FitzGerald et al. | 342/357.14 |
| 5,556,281 | A | * | 9/1996 | FitzGerald et al. | 434/16 |
| 5,571,018 | A | * | 11/1996 | FitzGerald | 434/16 |
| 5,596,509 | A | * | 1/1997 | Karr | 235/411 |
| 5,690,491 | A | * | 11/1997 | FitzGerald et al. | 434/16 |
| 5,788,500 | A | | 8/1998 | Gerber | |
| 5,892,221 | A | * | 4/1999 | Lev | 250/222.1 |
| 5,966,226 | A | * | 10/1999 | Gerber | 398/108 |
| 6,139,323 | A | * | 10/2000 | Christians et al. | 434/16 |
| 6,254,394 | B1 | * | 7/2001 | Draper et al. | 434/11 |
| 6,283,756 | B1 | * | 9/2001 | Danckwerth et al. | 434/11 |
| 6,386,879 | B1 | | 5/2002 | Varshneya et al. | |
| 6,398,555 | B1 | * | 6/2002 | Gerber et al. | 434/22 |
| 6,549,872 | B2 | * | 4/2003 | Bollweg et al. | 702/158 |
| 6,569,011 | B1 | * | 5/2003 | Lynch et al. | 463/1 |
| 6,638,070 | B1 | * | 10/2003 | Healy et al. | 434/22 |
| 6,914,731 | B2 | * | 7/2005 | Fredriksson | 359/754 |
| 6,945,780 | B2 | * | 9/2005 | Perry | 434/11 |
| 7,001,182 | B2 | * | 2/2006 | Lazecki et al. | 434/11 |
| 2002/0045999 | A1 | | 4/2002 | Bollweg et al. | |
| 2002/0150866 | A1 | * | 10/2002 | Perry et al. | 434/62 |
| 2004/0033472 | A1 | * | 2/2004 | Varshneya | 434/23 |
| 2004/0219491 | A1 | * | 11/2004 | Shlomo | 434/11 |

* cited by examiner

SYSTEM AND METHOD FOR WEAPON EFFECT SIMULATION

CROSS-REFERENCE TO RELATED APPLICATIONS

This application claims priority to European patent application 04075953.2 filed 26 Mar. 2004 and is the national phase under 35 U.S.C. §371 of PCT/EP2005/002728 filed 15 Mar. 2005.

TECHNICAL AREA

The present invention comprises a weapon effect simulation system comprising a fire simulation system and at least one hit simulation system, wherein the fire simulation system comprises means for emitting electromagnetic waves to simulate real ammunition from a weapon, and means for including information in the electromagnetic waves, and wherein said at least one hit simulation system comprises means for receiving the emitted electromagnetic waves and means for determining from received electromagnetic waves whether a target has been hit. Ammunition refers to grenades, projectiles, missiles, rockets (i.e. projectiles with rocket engines), mines, etc.

The invention further comprises a method for simulating real ammunition.

STATE OF THE ART

When, in the same manner as during actual firing, a weapon is aimed at a target during fire simulation, it is necessary to determine the extent to which a live round fired using the alignment that the weapon has during the simulated firing would or would not hit the target, the hit location and the effect of the hit.

U.S. Pat. No. 4,218,834 describes a weapon simulation method based on a laser transmitter disposed on or near the weapon that emits laser radiation in the direction in which the weapon is pointed, and based on the targets between equipped with reflectors arranged so as to reflect the laser radiation back toward the weapon. Means disposed at the weapon to generate a projectile trajectory signal are started simultaneous with the firing of a simulated projectile. The projectile trajectory signal reproduces the continuously changing position of an imagined real projectile fired at the same moment as the simulated projectile, and contains a distance value calculated with reference to the weapon, plus calculated aiming values referenced to a predetermined axis pointing from the weapon in the direction of the projectile trajectory.

The laser radiation is caused to execute a sweeping movement in order to scan an area in front of the weapon, whereupon the radiation that is reflected from target reflectors located in front of the weapon is received. Signals are generated from the received radiation that contain a distance value based on a measurement of the time between the transmission and reception of the reflected radiation, which value is comparable with the calculated distance value, and aiming values corresponding to the current radiation, which aiming values are comparable with the calculated aiming values. The measured values are compared with the comparable calculated values in order to determine whether the real projectile would have hit the target. Selectivity in connection with the transmission of information to only one of a plurality of conceivable targets within the solid angle area swept by the sweeping movement is achieved in that the information is transmitted only for as long as reflected radiation is being received from each respective reflector. Selectivity with respect to receiving information is achieved in that certain conditions are set in order for received information to be accepted. Additional selectivity is achieved in that the foregoing valid information is transmitted only during those sweep periods that correspond to a correct distance having been attained in the ongoing projectile trajectory simulation. The foregoing conditions are described in detail in the weapon simulation method specified in U.S. Pat. No. 4,218,834.

U.S. Pat. No. 6,386,879 describes a weapon simulation system based on similar principles, but here the target is arranged so as to receive and assess received radiation. This system thus uses no reflectors. A GPS antenna is disposed in connection with the weapon, via which antenna position information for the weapon is received. Means for emitting laser radiation and for including information concerning the time the projectile was fired, the weapon identity, weapon type, projectile type, weapon angles of inclination and rotation, the geographical position and, if applicable, the speed of the weapon are also present in connection with the weapon. In the target there are means for detecting the laser radiation in order to determine azimuth and elevation data for the target, means for determining a range to the target by comparing the received GPS coordinates for the weapon with the GPS coordinates for the target as measured by means of a GPS received disposed in the target, and means for determining a hit location relative to the target for a ballistic projectile fired from the weapon at the time of firing as based on determined azimuth and elevation data for the target plus information included in the laser radiation.

DESCRIPTION OF THE INVENTION

One object of the present invention is to achieve a weapon simulation system that enables precision simulation of ammunition fired at both moving targets and standing targets, without the presence of reflectors, and wherein different targets can selectively use received information.

This has been achieved according to one embodiment of the present invention by means of a weapon effect simulation system comprising a fire simulation system (also referred to as a "firing system") and at least one hit simulation system (also referred to as a "target system"). The fire simulation system comprises means for emitting electromagnetic waves to simulate real ammunition from a weapon, and means for including information in the electromagnetic waves, wherein the means for emitting electromagnetic waves preferably comprise a laser transmitter arranged so as to emit laser radiation with at least one radiation lobe. Said at least one hit simulation system comprises means for receiving the emitted electromagnetic waves and means for determining from received electromagnetic waves whether a target has been hit. The weapon effect simulation system is characterized in that the fire simulation system further comprises means for calculating the imagined trajectory of the real ammunition, and in that the means for including information in the electromagnetic waves are arranged so as to include information related to coordinates in the three-dimensional space for the calculated ammunition trajectory in a selected coordinate system.

Systems according to the present invention are, like U.S. Pat. No. 6,386,879, predicated on the target system itself assessing hit locations based on information received from firing systems. Simulation according to U.S. Pat. No. 6,386,879 is based on transmitting complete documentation in the form of the geographical position, speed and direction of the firing system at the instant of firing, the alignment of the weapon, etc., to the target after the instant of firing for subsequent processing in the target system. The target system itself calculates, based on the provided documentation, a hit location in relation to the target, including the entire movement of the target during the flight time of the ammunition. One of the disadvantages of the system according to U.S. Pat. No. 6,386,879 is that it does not permit any realistic simulation of ammunition that is guided by the gunner or observer/forward observer, wherein the trajectory of the ammunition can be corrected after firing. The present invention does enable this type of guidance, since the system is, as noted above, based on the fact that it is primarily the firing system that calculates and intermediates the ammunition trajectory. For example, weapons such as the Javelin, with which the gunner can switch targets during the flight of the ammunition by adjusting the trajectory with a joystick, can be simulated in a realistic manner by using the invention. However, certain elements of guidance are sometimes most appropriately simulated in the target system, and particularly during the final trajectory phase, during which certain autonomous ammunition contains its own terminally guided target-seeking capacity. However, as is the case with the Javelin, this is usually preceded by a longer sequence during which the gunner and weapon platform can guide the ammunition, and where the ability to update transmitted information during the course of the simulation can be decisive.

The invention further enables realistic simulation of guided ammunition, weapons of the "Fire & Forget" or "Hunter-Kill" type, and ammunition that allows for target switching, using generalized methods. The system is suitable for both tactical training and firing range training. In the case of tactical training the players, e.g. vehicles and soldiers, are usually equipped with both fire simulation systems and hit simulation systems. Two-sided tactical exercises can thus be conducted, giving different units an opportunity to train against one another in a realistic manner. The hit simulation system is then usually operatively connected to the fire simulation system of the player. If the hit assessment from the hit simulation system determines that a hit corresponds to serious damage/injury to the player, the ability of the player to fire can be blocked via the fire simulation system. In addition, ongoing fire simulation may need to be broken off immediately in certain cases. One such case involves the simulation of guided ammunition, where the gunner can guide the ammunition toward the target during its flight time. If, during the flight time, the player is fired on and hit, it is especially important that the simulation can be broken off immediately.

Another disadvantage of U.S. Pat. No. 6,386,879 is that the system is based on the use (simulation) of target input prior to firing so that it can then communicate with, in this case, the weapon system of the tank for any alignment adjustments, which is not a solution that is generally applicable to all types of weapons. The present invention is more general in nature, and permits the presence of operative range finders (LRF), identification equipment (IFF), laser pointers, etc., but is not based on the presence of any one type.

The invention is in part similar to U.S. Pat. No. 4,218,834 in terms of the firing system and functionality, but differs markedly in terms of the target system, insofar as it lacks reflectors. Reflectors offer an effective method for achieving high precision in the simulation by means of lasers. The disadvantage of basing the simulation on the presence of reflectors can sometimes be decisive. One such example involves simulated firing at larger targets, e.g. residential buildings, where a large number of reflectors would be needed to sufficiently cover the target so that the hit assessment would yield a realistic effect simulation. If firing on, e.g. a house is to be simulated in a realistic way, then the hit location on the outside wall must be determined with such precision that not only the effect on the outside wall is simulated, including visualization of, e.g. pyro and light, but also the effect on the rooms located behind the wall. The residual effect in the rooms behind the wall, where one or more rooms may be affected can, like the simulation of the effect on the house itself, be visualized with, e.g. pyro and light. To further enhance the realism, the effect on secondary objects such as persons and objects who are located in the affected rooms when they are fired upon must also be simulated, which demands precision in terms of the hit location determination for the house for specific types of ammunition, e.g. arrow shells.

In the absence of reflectors, the invention thus offers simplified installation and a substantially more cost-effective system for larger targets. Installation on other targets, such as vehicles and soldiers, is of course also simplified because reflectors can be avoided. In terms of size, the laser detectors are generally smaller and lighter than reflectors. The absence of reflectors means that the laser detectors can be mounted with greater freedom, since they do not need to be positioned in immediate proximity to a reflector. The invention does however permit the presence of reflectors, as well as functionality as per U.S. Pat. No. 4,218,834 in parallel with functionality as per the present invention, which is of particular interest in connection with, e.g. the training of gunners and situations where the target is advantageously passive and, in its simplest embodiment, consists of e.g. a reflector placed on a target sheet. Firing range training can thus take place in parallel with other combat training as an alternative, and in a simple way.

According to one preferred embodiment, the means for including information in the electromagnetic waves are arranged so as to include, continuously and based on the calculated trajectory, information concerning the current trajectory position of the real ammunition. As noted above, the weapon effect simulation system according to the invention is, in its basic embodiment, based not on having a reflector reflect a laser pulse in order to transmit the ammunition position to the target, but rather on the firing system continuously sending out information about the ammunition position regardless of whether or not there is any target present within the range of the transmitted electromagnetic waves. This means that all targets that are located within the range of the electromagnetic waves will receive as much information as is possible for the given situation, and will base their hit location calculations on that information. Those targets that sporadically, initially or ultimately do not have contact with the firing system can, based on the information received and their own knowledge of the ammunition ballistics, extrapolate a hit location with good precision, and also assess the effect on the target.

In one embodiment of the invention, information about the entire trajectory of the real ammunition can also be time-compressed, i.e. transmitted during a period of time that is shorter than the flight time of the real ammunition. If, for example, the weapon system is of the "Fire & Forget" type, the entire trajectory can be calculated and transmitted during a period of time that is shorter than the flight time of the ammunition so that the transmission can be completed while the gunner still sees the target. When the gunner then releases the target from his sight and throws himself down, it is no longer possible to transmit the trajectory information. This principle is also important in the "Hunter-Kill" case, i.e. when, after firing at a target, the gunner quickly re-aims at another target indicated by, e.g. the tank commander or another observer/forward observer. In an embodiment in which the trajectory information is transmitted more compressed in time, the firing system can, e.g. in order to simulate timed ammunition with a surface effect, such as grenades from an M203, transmit only information regarding the final ammunition position. The transmission of the information regarding the final ammunition position can, in and of itself, be repeated for as long as possible in order to increase the likelihood that all targets within the reception area of the electromagnetic waves will have received it. Given that the firing system sends the ammunition trajectory position regardless of whether or not it sees a target, both this embodiment in particular and other embodiments of the invention open up the possibility of simulating ammunition with a surface effect, lateral effects of ammunition (e.g. near miss, far miss, etc.) and more. The respective target (hit simulation system) that received or calculated the final ammunition position based on received information then calculates an effect, even if the target is not hit directly. All geographically disparate targets that independently calculate hit locations and effects based on their own geographical positions thus cooperate in simulating the ammunition with a surface effect.

As noted above, the means for transmitting electromagnetic waves comprise, e.g. a laser transmitter, but they could instead comprise a transmitter of another type, such as a radio transmitter. The means for transmitting electromagnetic waves could alternatively comprise both a laser transmitter and a radio transmitter. According to one embodiment, the radio transmitter is then arranged to transmit the coordinates of the weapon in a selected coordinate system (e.g. latitude, longitude and altitude), while the laser transmitter transmits information concerning the position of the ammunition relative to the position of the weapon. The radio waves travel either directly from the fire simulation system to the hit simulation system or via one or more base stations and/or a central unit. The means of the hit simulation system for determining a hit based on received electromagnetic waves are arranged so as to first determine the coordinates of the ammunition in a selected coordinate system and so as to then compare the determined coordinates with the coordinates of the target. According to an alternative embodiment, the laser transmitter and the radio transmitter both transmit information about the coordinates of the weapon and information related to the position of the ammunition in relation to the weapon, in which embodiment the means for determining whether the goal has been hit can be arranged so as to first determine the hit location at the target based on the information in the laser radiation, and second based on the information in the radio waves. According to yet another alternative embodiment, both laser transmitter and radio transmitter transmit information about the position of the ammunition as indicated directly in the selected coordinate system. Here too the means for determining whether the target has been hit can be arranged so as to first determine a hit based on the information in the laser radiation and second based on the information in the radio waves. In the event that the firing system is stationary, these positions can be stored in the hit simulation systems, whereupon the information concerning the positions of the firing system need not be transmitted. In the event that the hit simulation systems are stationary, coordinates from the fire simulation system can be communicated in part by means other than by laser and radio. For example, hit simulation systems disposed on buildings can be linked by LAN to a central unit that is receiving information transmitted by radio from the fire simulation system via one or more radio base stations.

According to one embodiment, the fire simulation system is either partly or entirely disposed at a weapon. A communication system that communicates with an observer/forward observer may alternatively be present at the weapon. The fire simulation system can then be disposed in connection with the observer/forward observer, whereupon the fire simulation system is initiated based on the observations and measurements made by the observer/forward observer and/or based on data related to the weapon (e.g. its azimuth, elevation, firing) that are received via the communication system. The weapon can be a live weapon or a replica of a live weapon. The weapon can, for instance, be person-borne or vehicle-borne. In yet another embodiment the weapon is virtual, and its entire existence is simulated by a fire simulation system at the observer/forward observer, or a command and control system.

The ammunition that is simulated consists of, e.g. grenades, projectiles, missiles, rockets (i.e. projectiles with rocket engines), mines, etc. The means for calculating the imagined trajectory of the simulated ammunition are arranged so as to calculate the trajectory based on ammunition type. For ammunition with a ballistic trajectory, the trajectory calculating means utilize, in a known manner, the azimuth and elevation of the weapon, the weight of the ammunition and the actual muzzle velocity of the weapon to calculate the trajectory.

The momentary position of the ammunition along its trajectory, expressed as coordinates in the three-dimensional space, can be determined from the range, azimuth and elevation relative to the position status of the actual or virtual weapon. In yet another example, the momentary position of the ammunition along its trajectory is described by distance plus radial angles relative to the weapon and the position status of the weapon. To achieve such a simulation, the simulation system requires access to a geographical position indicator (such as GPS) in order to determine the geographical position. In a case involving guided ammunition, the gunner or observer/forward observer can guide the ammunition. For example, the ammunition is guided continuously using a joystick, whereupon the positional status of the joystick is continuously fed to the trajectory calculating means. In an alternative case where the ammunition is guided toward the target automatically, the trajectory calculating means are arranged to simulate an autoseeking function. In addition to the foregoing trajectory parameters (ballistic trajectory, manually guided trajectory, automatically guided trajectory), which are determined by the ammunition chosen and the weapon type, the trajectory is based on one or more predetermined parameters. These predetermined parameters include, e.g. timing ranges and variable time fuses on/off, which are set by the gunner, observer or command and control system. The trajectory calculating means can also determine the trajectory based on stochastic parameters, such as weather conditions. Furthermore, e.g. topographical conditions and other terrain conditions can be allowed to influence the trajectory calculating means in determining the possible trajectory.

According to one embodiment, a transmitter disposed at the weapon is arranged so as to transmit, e.g. by radio, information concerning the geographical position of the weapon, while a receiver disposed at the target is arranged so as to receive said position information. The information included in the electromagnetic waves can thus describe the ammunition trajectory relative to the position of the weapon in order to thereby enable more compact coding.

The present invention further concerns a method for simulating the effect of a weapon on one or more potential targets. According to this method, electromagnetic waves for simulating real ammunition from a weapon are modulated with information, and the modulated electromagnetic waves are transmitted for reception by the potential targets, whereupon, following reception, a determination is made for each respective target as to whether that target has been hit, based on the received electromagnetic waves. The method is characterized in that the imagined trajectory of the simulated ammunition is calculated, and in that the information that is modulated with the electromagnetic waves includes information related to the calculated ammunition trajectory. In addition to a determination as to whether the target has been hit, the hit location on the target is determined for a subsequent assessment of the effect on the target, based on the calculated trajectory.

According to one embodiment, the information regarding the current ammunition trajectory position for the imagined trajectory of the simulated ammunition is modulated with the electromagnetic waves continuously. The information about the entire trajectory of the real ammunition can also be encompassed within a time that is shorter than the actual time. For example, if the weapon system is of the "Fire & Forget" type, the entire trajectory can be calculated and transmitted over the period of time in which the gunner sees the target so that the transmission can be completed before the gunner releases the target from the sight and throws himself down. This principle is also important in the "Hunter-Kill" case, i.e. when, after firing at a target indicated by the tank commander, the gunner immediately aims at another target indicated by an observer/forward observer. This compressed type of simulation can also yield a simplified requirement set if, e.g. gyro-stabilization is used to compensate for weapon movements after the start of the simulation, which can in turn enable a simplified simulation system. This is because the internal drift of the gyro will be summed over a shorter period of time.

In a simple application embodiment, the weapon effect simulation system is a pure one-way simulator, i.e. all communication flows one way from the fire simulation system to the hit simulation system. This opens up the possibility of seamless integration with simpler simulators that are currently of the one-way type (such as MILES), and which are used most advantageously to simulate ammunition from small arms, and for which the requirements in terms of precision are deemed to be lower. The precision of these simulations can be increased by also using the present invention for simulating ammunition from small arms. This is particularly important in connection with, e.g. sharpshooters/snipers, where precision is decisive.

In an alternative embodiment involving a more complex weapon effect simulation system, a laser transmitter incorporated in the firing system transmits laser radiation in the direction in which the actual weapon is aimed via a sweeping movement, whereupon the laser radiation propagates in a fan-shaped beam toward a target area, and wherein the targets are equipped with detectors to receive this laser radiation. Simultaneous with the firing of a simulated round of ammunition, means disposed at the weapon and intended for the purpose begin to generate a projectile trajectory signal. The projectile trajectory signal reproduces the continuously changing position of an imagined real round of ammunition fired at the same instant as the simulated ammunition, and contains a distance value calculated with reference to the weapon. The laser radiation is caused to describe a sweeping movement in order to send information to the detectors that are disposed in front of the weapon. Each sweep then normally corresponds to a given distance from the firing system. The distance interval between sweeps can differ in length depending on the type of ammunition being simulated. As noted earlier, the weapon effect simulation system does not use reflectors. Its function is instead achieved in that the position information for the current ammunition is transmitted preferably throughout the entire sweeping movement. In addition, information corresponding to the distance of the ammunition is transmitted for the current sweep, wherein the distance is preferably given relative to the firing system. The transmitted position information changes continuously during the sweep. The lobes of the laser radiation have a long and narrow cross-section, and the lobes are extended along separate planes. Instantaneous information about the position of the simulated ammunition in a specific sweep is transmitted, e.g. as the relative perpendicular distance from at least two of the respective center lines of the lobes to the point that represents the position of the ammunition in the current sweep. The situation may be viewed as though the forward- and backward-moving lobes, which have a known mutual angular relationship, together create, through the sweep, a coordinate system for the illuminated targets, in which system the position of the ammunition, placed at, e.g. the origin, is determined at a given distance from the weapon. In the present invention, information about the geographical position of the firing system is also transmitted to the target system, normally along with information about the ammunition type and system identity as well. Based on the received information related to coordinates in the three-dimensional space for the calculated ammunition trajectory, expressed as range, azimuth and elevation, plus the information about the geographical position of the firing system and its own geographical position, and based on the calculated distance between them, a receiver can then determine the position of the passage of the ammunition at its own geographical location. The geographical position of the firing system can be transmitted to receiving systems together with the position of the ammunition via laser, thereby yielding a true one-way precision simulation. Alternatively, the geographical position of the firing system may be transmitted separately from the ammunition position, e.g. by radio. A target system that is, e.g. in the field of view of a firing system throughout the entire simulation process will thus receive information from a higher number of sweeps, i.e. including those sweeps that transmit information about the trajectory position long before or long after the position that corresponds approximately to the distance between the firing system and the target system. This means that a detector that is positioned somewhere along a line viewed from the firing system will be able to obtain the same information, regardless of its distance to the firing system. Given that the target system possesses knowledge of the geographical position of the firing system, the geographical position of the target system and distance information for each respective sweep, the target system can independently and selectively select the sweeps that have the correct distance for use in its hit assessment, based on the calculated distance between the firing system and the target system. Because the geometric relationships between firing system and target system are known, the target system is also able to, e.g. correct for the fact that information has been received from sweeps for a somewhat shorter or longer distance than the exact current distance between firing system and target system.

In summary, the system according to the invention and the method according to the invention offer numerous advantages. First, the ammunition can be simulated with great precision. The high precision is achieved because hit points for the simulated ammunition are based solely on the calculated trajectory of the real ammunition and knowledge of the position of the target. The information about the calculated trajectory is transmitted to the hit simulation system throughout all or parts of the flight time of the ammunition. For weapon systems of the "Fire & Forget" type, the entire trajectory can be calculated and transmitted during a period of time that is shorter than the flight time of the ammunition, so that the transmission will be completed while the gunner still sees the target. In its simplest application embodiment, simulation of ammunition from small arms can also be performed with greater precision than at present. No reflectors are needed in the target, since the trajectory coordinates are instead derived from the information in the electromagnetic waves and, optionally, information about the firing system stored in the hit simulation system. In addition, the ammunition can be allowed to be guided or corrected after firing, making it possible to simulate a larger number of weapon types than before.

PREFERRED EMBODIMENTS

Figure 1:
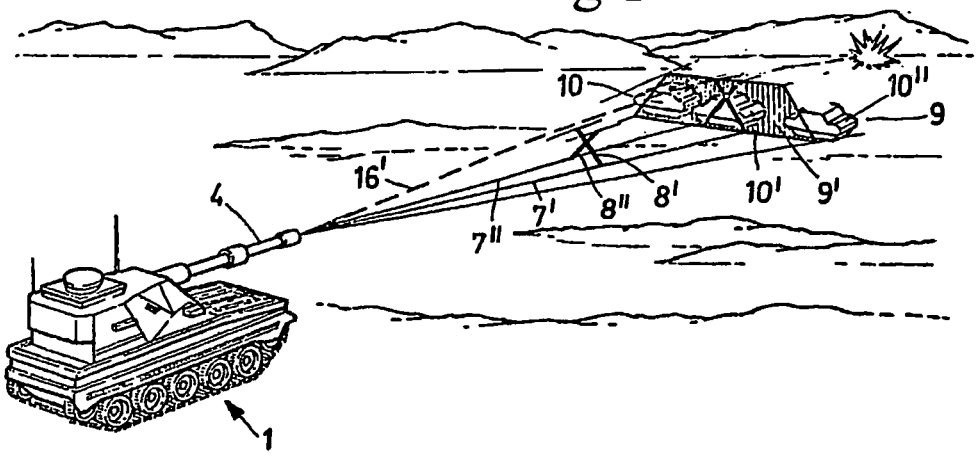
FIG. 1 shows an example of an application of the invention for firing practice.
Figure 2:
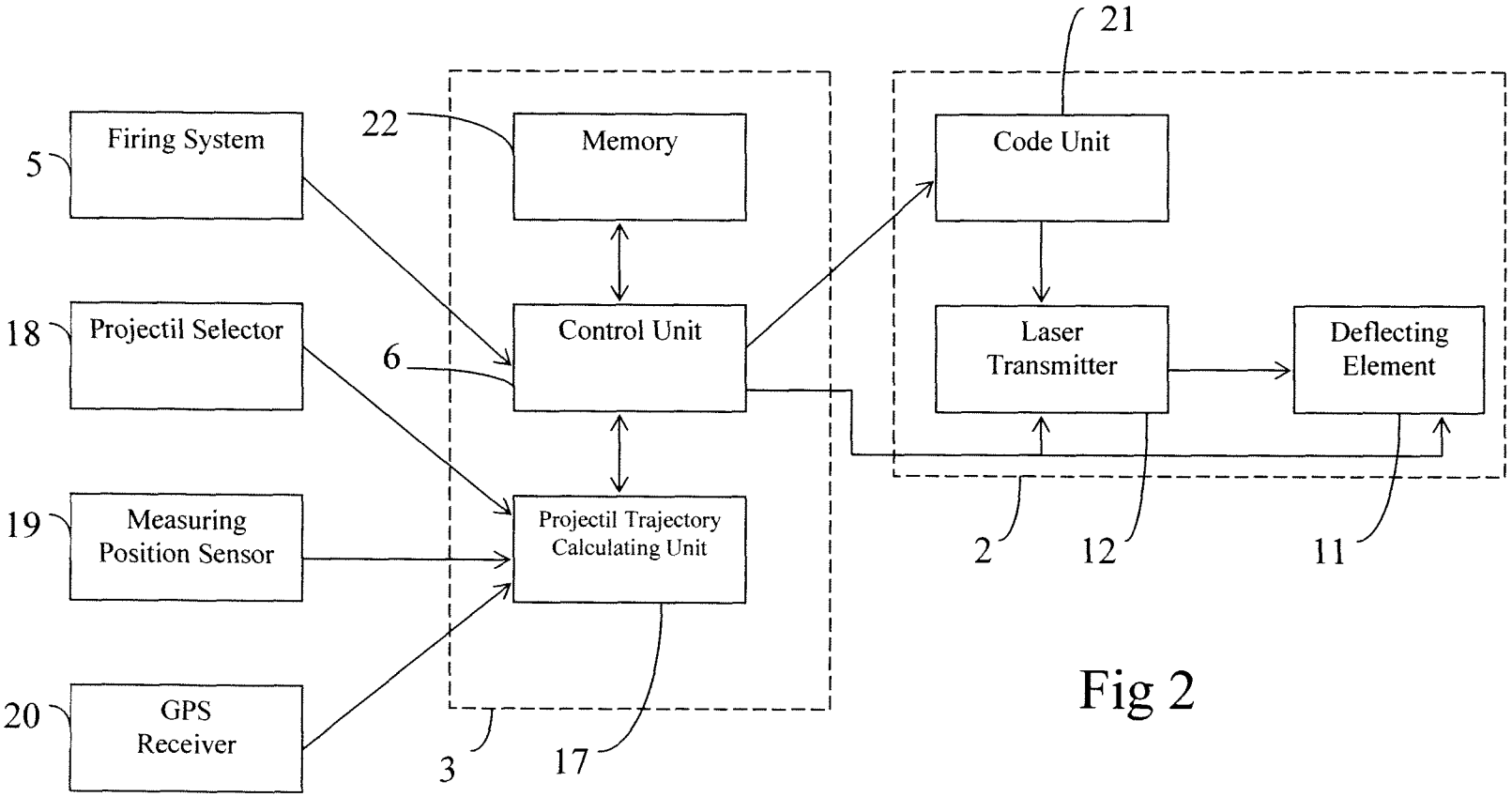
FIG. 2 shows a block diagram of the simulation equipment contained in the tank depicted in FIG. 1 according to a first embodiment.

A conventional weapon, which consists in the example according to FIG. 1 of a gun on a tank 1, can be used in simulated firing practice. In FIG. 2, a weapon system comprises the gun and a simulation system disposed at the gun. The simulation system in turn comprises a transmitter device 2 disposed in connection with the gun, suitably in the barrel 4 of the gun, and a simulator unit 3. The simulator unit 3 is connected with a firing system 5 for the gun, an ammunition selector 18 for selecting the ammunition type, a measuring position sensor 19 to determine the motion status of the weapon, and a GPS receiver 20 that receives the geographical position of the simulator unit 3. According to one embodiment, the GPS receiver is supplemented with a radio receiver for receiving a correcting signal, so-called DGPS.

The weapon is aimed and fired as though a real round were being fired, and each time the gunner fires the weapon, the transmitter equipment 2 is initiated in that a control unit 6 actuated by the firing system 5 of the tank causes a laser transmitter 12 in the equipment 2 to emit radiation in the direction of the barrel, which radiation is preferably pulsed. The laser radiation is shaped upon emission in a known manner into lobes 7' and 7" with long and narrow cross-sections 8' and 8", which extend along separate planes, forming an angle to one another. From the weapon, the radiation propagates in a fan-shaped beam toward a target area 9, which the gunner in the tank can monitor. In the target area there is a target group, which consists in the example shown of three vehicles 10, 10' and 10". The laser lobes 7' and 7" are caused to rapidly and periodically scan the target area 9 or a part thereof. This is achieved in a known way via deflecting elements 11 that are arranged in the beam path of the laser transmitter 12. In the unrestricted example illustrated in FIG. 1, the number of beam lobes used is two, but three or more beam lobes could optionally be used.

The deflecting elements 11, realized in the form of e.g. mutually movable optical wedges, are controlled by means of signals from the control unit 6 so that each lobe executes a forward- and backward-moving linear sweep movement with a predetermined speed and direction of movement within a predetermined solid angle area whose cross-section in FIG. 1, is designated 9', and which is suitably centered relative to the barrel.

The simulator unit 3 contains a memory 22 arranged so as to store an identity that is unique for the tank 1. The targets 10, 10' and 10" also each have a unique identity stored in a memory 31 (FIG. 4) belonging to each respective target. The tank 1 constantly receives geographical position information via the GPS receiver 20. The targets 10, 10' and 10" also possess knowledge regarding their current positions via a GPS receiver 32 disposed at each respective target.

Figure 3:
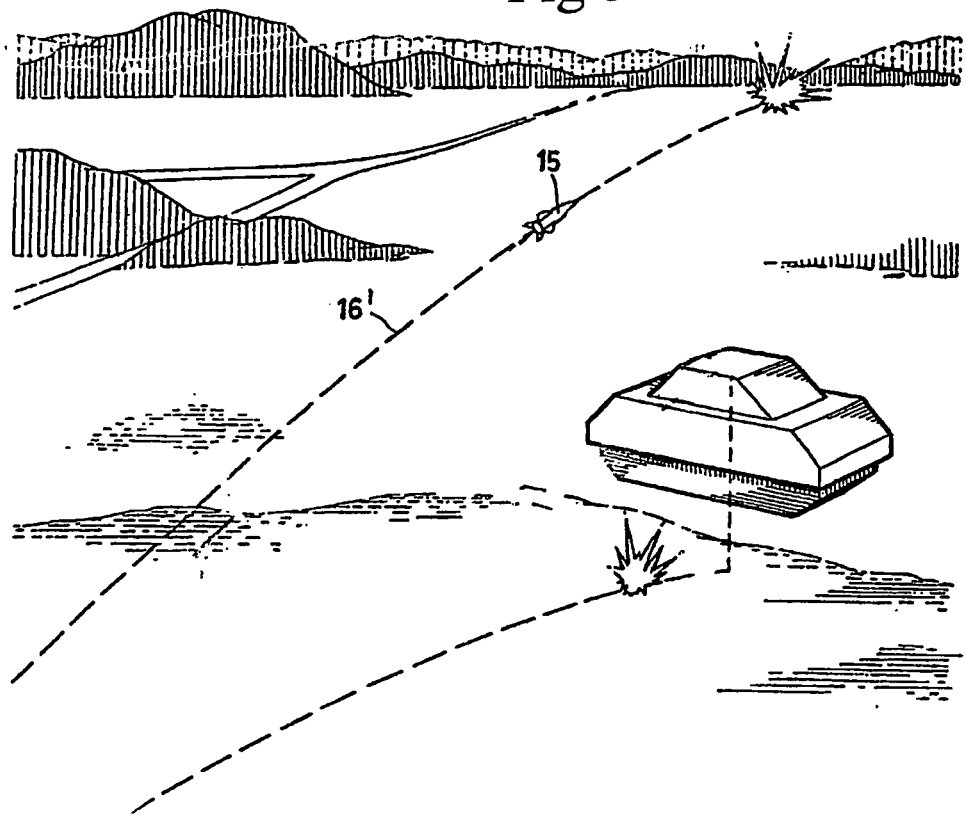
FIG. 3. shows the application in FIG. 2 with the imagined trajectory of a simulated round of ammunition marked.

In FIG. 2, the imagined trajectory 16' (FIG. 3) of an ammunition 15 is generated in that, upon firing of the weapon, an ammunition trajectory calculating unit 17 that works together with the control unit 6 is initiated to generate a signal that reproduces the trajectory 16' of the ammunition 15, taking into account such factors as will affect the trajectory before, after and at the instant of firing. Factors that are of interest before firing include the type of ammunition, which is selected in view of the target to be attacked. In the illustrative example, the gunner indicates the selected ammunition type by setting the ammunition selector 18, which is operatively connected with the ammunition trajectory calculating unit 17. Other factors that affect the ammunition trajectory are the alignment of the weapon and its motion status at the instant of firing. These parameters are supplied from the measuring position sensor, 19, which is operatively connected with the ammunition trajectory calculating unit. For example, the measuring position sensor 19 is equipped with a gyro by means of which the motion status of the weapon is detected. The influence of the atmosphere can affect the imagined ammunition trajectory both stochastically and as calculated based on known conditions from actual cases; such examples can include wind and air temperature. If the imagined ammunition is of a type that is guided after firing, then the guidance signals associated therewith are also included among the factors that can affect the imagined ammunition trajectory. The ammunition calculating unit 17 generates a signal that is determined relative to the direction of the gun and represents the imagined ammunition trajectory 16. The geographical position of the firing system from the GPS receiver 20 of the tank at the instant of firing is added to this signal to supply ammunition positions for the trajectory as an output signal. Ammunition position data representing the instantaneous ammunition trajectory position of the simulated ammunition can then contain, e.g. both the current range from the firing system, and azimuth and elevation relative to the direction of the firing system at the instant of firing, plus the geographical position of the firing system at the instant of firing. The more densely the points are calculated, the more accurate the simulation.

The information stored in the memory 22 regarding the identify of the weapon, the information from the selector 18 regarding the ammunition type, and the information regarding the current ammunition position from the ammunition trajectory calculating unit 18 is fed via the control unit 6 to a code unit 21 in the transmitter [Deleted: laser] equipment 2. In the code unit 21, the identity, ammunition type and current ammunition position data (e.g. range, azimuth, elevation and the geographical position of the firing system) relative to coordinates in the three-dimensional space for the calculated ammunition trajectory are converted into series of pulses and pauses by means of which the lobes 7' and 7" of the laser transmitter are modulated in a manner that is known per se. The control unit 6 is arranged so as to control the laser transmitter 12 and the deflecting element 11 so that the laser lobes 7' and 7" illuminate the target area 9 in sweeps transmitted throughout the entire simulation process, whereupon the data concerning the ammunition position are updated for each sweep based on the calculated ammunition trajectory.

Figure 4:
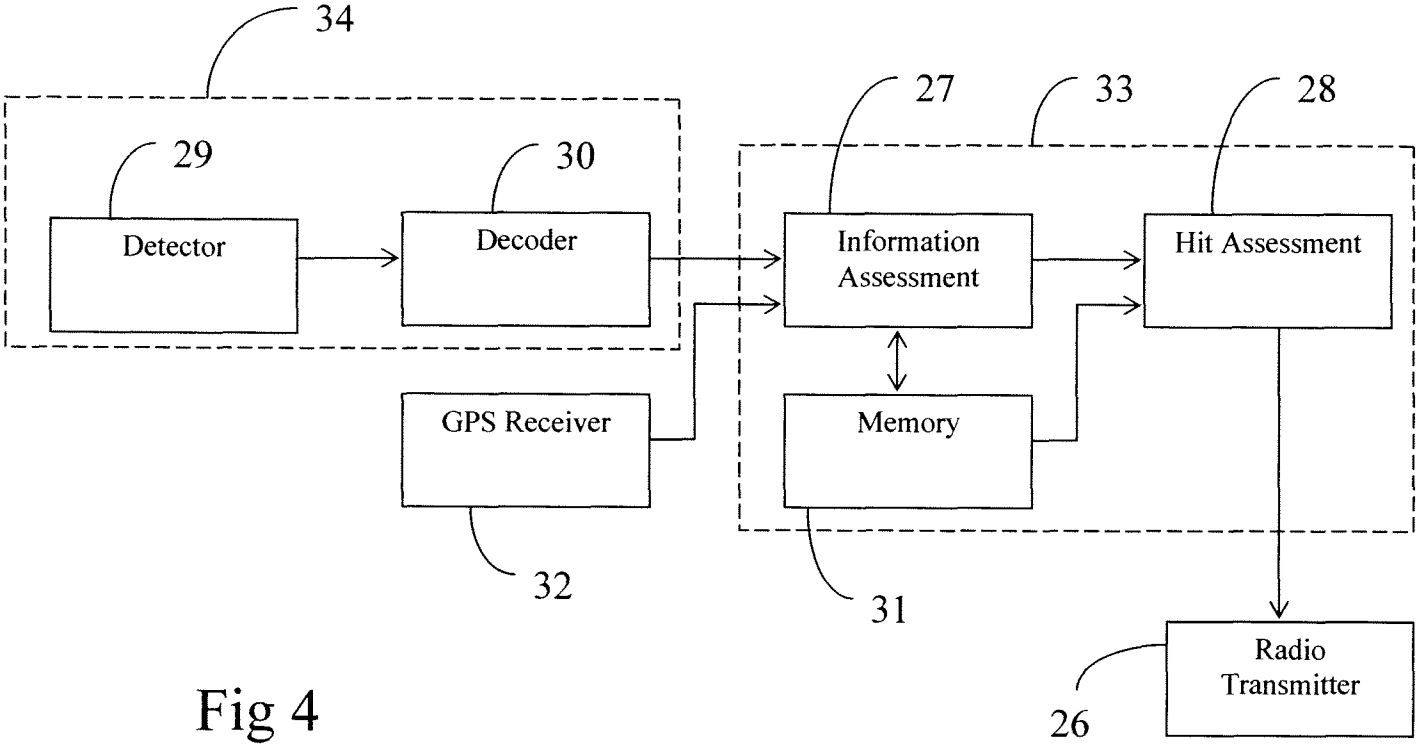
FIG. 4 shows a block diagram of equipment contained in a target depicted in FIG. 1 according to a first embodiment.

In one example, the ammunition calculating unit 17 is arranged so as to calculate the ammunition trajectory in real time, whereupon the most recently calculated value is fed continuously via the control unit to the code unit for transmission together with the laser radiation. Alternatively, the entire ammunition trajectory is calculated upon the firing of a simulated round, whereupon the values at the calculation points are output compressed over, e.g. 1-2 seconds, corresponding to a suitable period for "Fire-and-Forget" and "Hunter-Kill". The interval between respective sweeps should be chosen so that it is sufficiently short to achieve successful transmission to mobile targets such as vehicles, while higher update rates will at the same time yield higher levels of simulation accuracy. In FIG. 4, a target system at each target 10, 10' and 10" comprises a receiver unit 34 comprising one or more laser radiation-sensitive detectors 29 and a decoder 30. The fields of view of the detectors should be such that radiation can be detected in all occurring directions of fire as long as the target on which the detectors are disposed is not concealed. The information-bearing modulated radiation that is received by the detectors 29 is converted thereby into an electrical signal, which is fed to the decoder 30 for conversion into a form that is suitable for continued signal processing in an effect assessment unit 33. The assessment unit 33 comprises an information assessment unit 27 arranged so as to extract from the received information the identity of the unit transmitting the laser radiation and so as to compare, for each identity, the decoded ammunition position data with the target coordinates obtained via the GPS receiver 32 of the target. The ammunition position data and the target coordinates are stored together with the identity of the transmitting unit in the memory 31, which is contained in the effect assessment unit 33. If the comparison yields the result that the ammunition has not passed the target, new decoded ammunition position data are awaited for said identity. Upon reception of the new ammunition position data, they are compared with the target coordinates, whereupon the compared coordinates are fed to the memory 31 for storage as described above. At least in the case where the target is mobile, the coordinates for the target position are also updated for each new comparison. In one embodiment, the information transmitted from the transmission [Deleted: laser] equipment concerning the ammunition does not indicate the ammunition type, but rather indicates an identity that is unique for the ammunition, which identity in turn indicates the ammunition type. When the current position of the ammunition satisfied the condition that the ammunition has passed the target, the identity of the ammunition is, in this embodiment, stored in the memory 31 together with identity of the transmitting unit. The information assessment unit 27 is subsequently arranged so as to no longer process data for the ongoing simulation for this ammunition identity.

When the ammunition has passed the target, the information assessment unit 27 also feeds a signal to the hit assessment unit 28, which initiates a hit assessment. During the hit assessment, a hit location for the ammunition is first calculated. This calculation comprises, e.g. the following steps:

1. The ammunition positions stored in the memory 31 are retrieved.
2. An ammunition trajectory is calculated by interpolating the retrieved ammunition positions.
3. The GPS coordinates for the target stored in the memory 31 are retrieved.
4. A trajectory for the target is calculated by interpolating the retrieved target coordinates.
5. The orientation of the target is determined so that the hit point can be calculated with the correct angle of aspect on the target. The orientation can be determined based on, e.g. the direction obtained from the GPS receiver or knowledge as to which detectors have been illuminated.
6. The hit point is calculated as the point at which the above-generated curves intersect.

The aforedescribed calculation can also be performed continuously during the time while new ammunition positions are being received.

In the event that the simulation is terminated early, e.g. if the firing system goes into concealment, the hit assessment unit can instead, based on received information, extrapolate the continuation of the ammunition trajectory. To increase the reliability of the simulation in this case, the firing system can transmit supplemental information continuously by radio. The hit assessment unit can then use this information as a reference in its extrapolation as per the foregoing algorithm example. The information about the entire trajectory for the real ammunition can also be contained within a time interval that is shorter than the real interval. For example, if the weapon system is of the "Fire & Forget" type, the entire trajectory can be calculated and transmitted over the period of time in which the gunner sees the target, so that the transmission can be completed before the gunner then releases the target from the sight and throws himself down into concealment. This principle is also important in the "Hunter-Kill" case. The ammunition trajectory can then be calculated by interpolating the retrieved ammunition positions as per the above algorithm, but with the addition that the comparison with the geographical position path of the target can be shifted in time so that the correct geographical point for the target is awaited.

A vulnerability calculation is then performed to calculate the effect that a real round of ammunition would have had on the target if it had followed the same trajectory as the imagined ammunition. The calculation is based on, e.g. a predefined division of the target into different vulnerability fields, and translation of the above-calculated hit point into a field number. A hit within a specified field yields a specific effect, e.g. if a hit to the tank track results in a break in the track, causing the tank to become immobile, the soldiers inside the tank can continue to be combat-capable. The ammunition type is also taken into account in assessing the effect of the ammunition, since ammunition type information is stored in the memory 31. Additional examples of vulnerability calculations include firing on a house, where the hit location on the outer wall is determined with such precision that not only the effect on the outer wall is simulated, but also the residual effect on rooms behind the wall, whereupon one or more rooms may be affected. The effects on secondary objects such as people and objects that are present in the affected rooms when fired upon can thus be simulated as well. The effects on secondary objects can also be of significance in other situations, e.g. soldiers who are located in the immediate proximity of a vehicle that is hit, but where the soldiers are not directly exposed to the effect of the weapon because they are, e.g. concealed behind the vehicle.

According to an expanded embodiment, the ammunition trajectory calculating unit 17 calculates the distance that the ammunition has covered and supplies this information continuously to the code unit 21 along with the position information for the ammunition. The hit assessment unit 28 then takes the distance covered by the ammunition into account in assessing the effect of the ammunition. If a fuse range is also included in the information in the laser radiation, it is possible to simulate, e.g. a timed air burst. In this embodiment, the information assessment unit 27 can be arranged so as to compare the fuse range with information about the distance covered by the ammunition, and to activate the hit assessment unit 28 when the distance covered by the ammunition exceeds the fuse range, which unit will then perform a vulnerability calculation as above. Alternatively, the simulation equipment 3 contains means for performing said comparison, and means for changing the ammunition type when the ammunition has traveled so far that the fuse range has been traversed. One type of ammunition can thus have different types of effects on the targets, depending on range. In the example involving a timed fuse, only a direct hit is possible in the first phase, while with a fuse range, e.g. via a timed air burst, an effect on the surface of the targets is achieved.

Based on the hit assessment, the hit assessment unit 28 generates a message and supplies that message to a radio transmitter 26, which transmits the message. The message contains information regarding the damage that the ammunition 15 has inflicted on the target. The message can include, e.g. information about the identity of the target, the identity of the weapon that caused the damage, the ammunition type/ammunition identity, and the degree of damage inflicted on the target. During use in a military exercise, the message is received by a central unit that receives status messages from all the actors involved in the exercise that have a separate identity, such as people, weapons, vehicles, etc. In one example where the tank is equipped with a radio receiver 14 (FIG. 5) arranged so as to receive the status messages, the control unit 6 is arranged so as to break off the simulation of the ammunition 15 upon receiving a message that the ammunition 15 has hit. In the event that the tank is equipped with the radio receiver 14 arranged so as to receive the status messages, the gunner can also be re-supplied with the hit location and effect in that the information in the received status messages is converted into a graphical presentation and, e.g. reflected into the gunner sight. The firing system is then arranged so as to calculate, based on the received hit location, the coordinates in the sight and, based on received effect information, so as to select the type of symbol that represents said effect. The symbol is displayed at the calculated coordinates in the sight.

Figure 5:
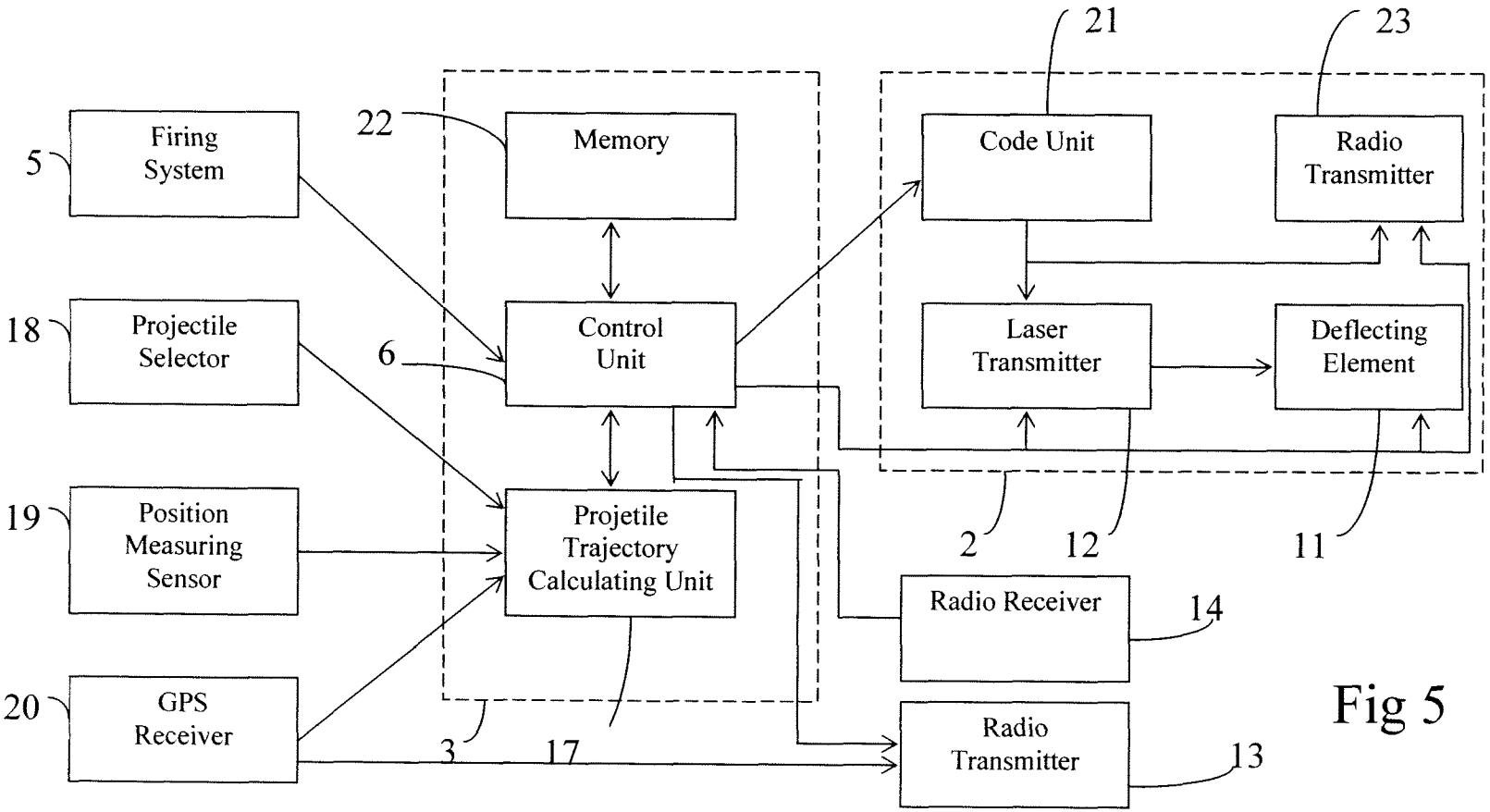
FIG. 5 shows a block diagram of the simulation equipment contained in the tank depicted in FIG. 1 according to a second embodiment.
Figure 6:
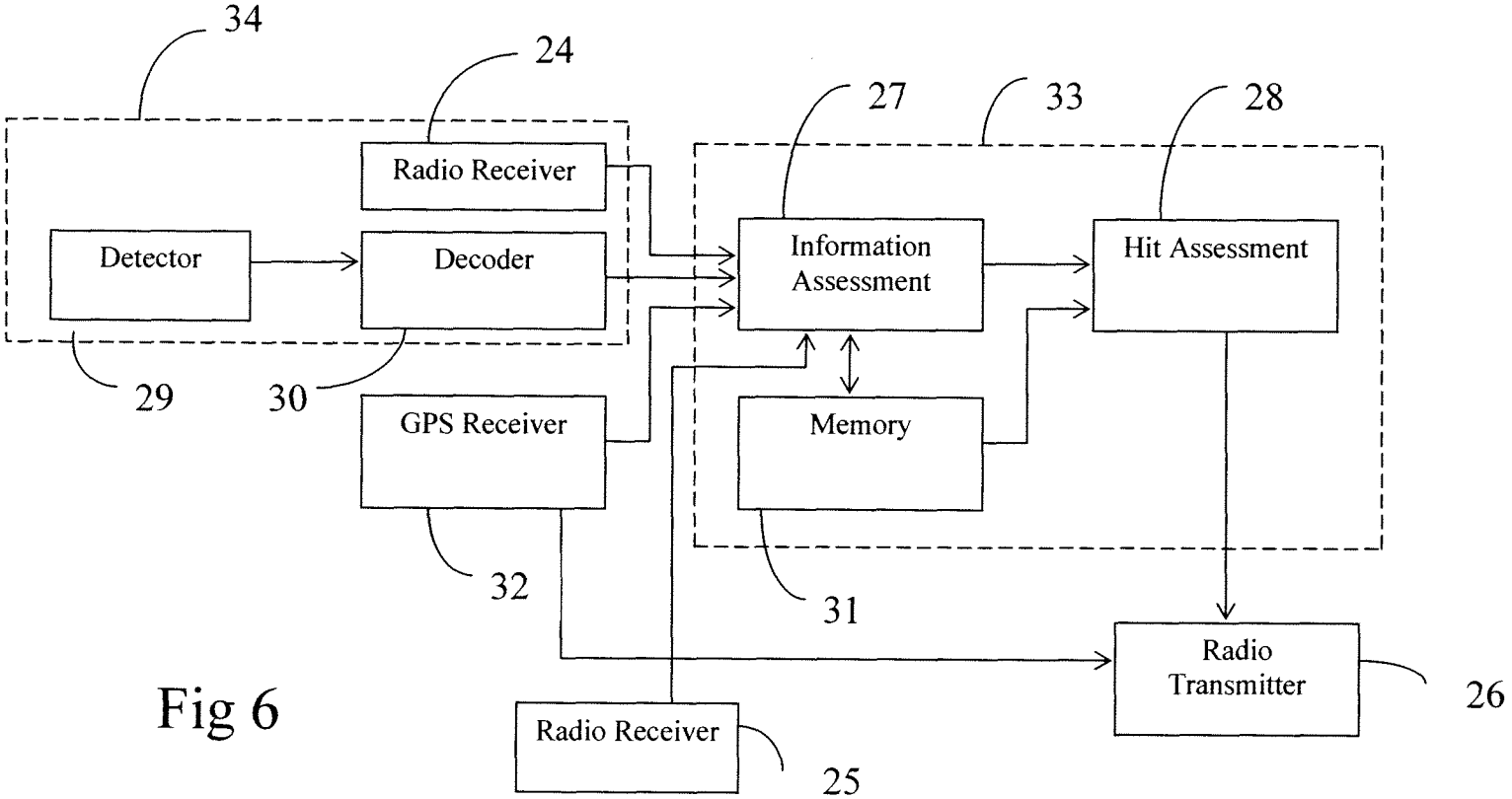
FIG. 6 shows a block diagram of equipment contained in a target depicted in FIG. 1 according to a second embodiment.

In FIG. 5 and FIG. 6, all actors such as weapons, vehicles and people can be connected to radio communication equipment. The actors are in this case also equipped with a GPS receiver. The actors thus have equipment to transmit information concerning their geographical positions by radio to other actors, and they can also receive geographical position information from other actors. The weapon system as per FIG. 5 is accordingly equipped with the aforementioned radio receiver 14 and a radio transmitter 13, while the target system according to FIG. 6 is equipped with a radio receiver 25 in addition to the radio transmitter 26 already in place. By exchanging information by radio, the target simulation systems at each target come to know the position of the fire simulation system. As a result, a considerably smaller amount of information is included in the laser radiation, since the geographical position of the firing system does not need to be included.

Furthermore, the transmitter equipment 2 in FIG. 5 contains a radio transmitter 23 connected to the code unit 21 and arranged so as to transmit identity, ammunition type and ammunition position information in the same way as the laser transmitter 12. The receiver unit 34 of the target systems is equipped with a radio receiver 24 that is arranged so as to receive information transmitted from the radio transmitter 23. The information assessment units 27 of the target systems are then arranged so as to assess the quality of the received laser radiation. If the quality of the laser radiation is satisfactory, further processing is carried out in the information assessment unit 27 and the hit assessment unit 28, based on the information coded in the laser radiation. If, on the other hand, the quality of the laser radiation is deemed unsatisfactory, then further processing is carried out based on the information coded in the radio waves.

The invention claimed is:

1. A weapon effect simulation system, comprising:

a weapon comprising a fire simulation system comprising a transmitter configured to transmit electromagnetic waves from a weapon to simulate real ammunition from the weapon, and the transmitter including information in the electromagnetic waves, the fire simulation system further comprising a calculating unit configured to calculate an entire imagined trajectory of the simulated ammunition and a processor configured to determine a geographical position of the weapon, wherein the transmitter is operative to include in the electromagnetic waves information related to the entire imagined calculated trajectory of the simulated ammunition given as coordinates in the three-dimensional space; and at least one target comprising a hit simulation system comprising a receiver configured to receive the transmitted electromagnetic waves from the weapon and a processor configured to determine whether a target has been hit based on the information related to the entire imagined calculated trajectory of the simulated ammunition given as coordinates in the three-dimensional space in the received electromagnetic waves.

2. The weapon effect simulation system according to claim 1, wherein the transmitter comprises a laser transmitter operative to transmit laser radiation with at least one beam lobe.

3. The weapon effect simulation system according to claim 2, wherein the transmitter further comprises a radio transmitter operative to transmit radio waves.

4. The weapon effect simulation system according to claim 3, wherein the processor is operative to determine target hits based primarily on the information in the laser radiation and secondarily on the information in the radio waves.

5. The weapon effect simulation system according to claim 1, wherein the transmitter comprises a radio transmitter operative to transmit radio waves.

6. The weapon effect simulation system according to claim 1, wherein the transmitter is operative to continuously include, based on the calculated trajectory, information concerning the current trajectory position of the simulated ammunition.

7. The weapon effect simulation system according to claim 1, wherein the processor is operative to include, during a period of time that is shorter than the flight time of the real ammunition and based on the calculated trajectory, information concerning the trajectory positions of the simulated ammunition.

8. The weapon effect simulation system according to claim 1, wherein the calculating unit is operative to determine an impact point or burst point of the ammunition, and wherein the information related to the calculated ammunition trajectory contains the impact point or burst point.

9. The weapon effect simulation system according to claim 1, wherein the fire simulation system comprises a transmitter operative to transmit information regarding the geographical position of the weapon, and wherein at least one target comprises a hit simulation comprising a receiver operative to receive said position data.

10. The weapon effect simulation system according to claim 9, wherein the information related to the calculated ammunition trajectory is determined relative to the geographical position of the weapon.

11. The weapon effect simulation system according to claim 1, wherein said hit simulation system comprises a processor configured to determine the geographical position of the target.

12. The weapon effect simulation system according to claim 11, wherein at least one of the targets comprises a hit simulation system comprising a transmitter, and wherein the fire simulation system comprises a receiver operative to receive information from the transmitter of the hit simulation system.

13. The weapon effect simulation system according to claim 12, wherein the transmitter of the hit simulation system is operative to transmit information regarding the geographical position of the target.

14. The weapon effect simulation system according to claim 13, wherein the calculating unit is operative to determine which target has been hit, and wherein the information related to the calculated ammunition trajectory includes information that identifies the determined target.

15. The weapon effect simulation system according to claim 12, wherein the transmitter of the hit simulation system is operative to transmit a hit message upon determination of a hit.

16. The weapon effect simulation system according to claim 15, wherein a receiver for a hit simulation system that has not determined a hit acts as a secondary object and is operative to receive the transmitted hit message.

17. The weapon effect simulation system according to claim 16, wherein the processor is operative to decide upon receiving hit messages whether the secondary object has been hit.

18. The weapon effect simulation system according to claim 15, wherein the transmitter is operatively connected with the receiver of the fire simulation system and is operative to break off the simulation upon receiving the hit message.

19. The weapon effect simulation system according to claim 15, wherein the fire simulation system comprises a display configured to display hit locations and effects based on received hit messages.

20. The weapon effect simulation system according to claim 19, wherein the display is operative to display hit locations and effects visually.

21. The weapon effect simulation system according to claim 1, wherein the fire simulation system is disposed at a weapon.

22. The weapon effect simulation system according to claim 1, wherein the processor has a geographical position that is separate from the geographical position of the transmitter.

23. The weapon effect simulation system according to claim 1, wherein said at least one hit simulation system is disposed in connection with a respective target.

24. The weapon effect simulation system according to claim 1, wherein the processor is operative to determine a hit location on the target.

25. The weapon effect simulation system according to claim 1, wherein the processor is operatively connected with the transmitter of the fire simulation system and operative to break off the simulation if a hit is determined corresponding to damage or injury that renders continued firing impossible.

* * * * *